US009677858B1

(12) United States Patent
Speyer et al.

(10) Patent No.: US 9,677,858 B1
(45) Date of Patent: Jun. 13, 2017

(54) METHOD FOR WRAPPING OF CERAMIC TILES FOR ARMOR APPLICATIONS, A WRAPPED CERAMIC TILE FOR ARMOR APPLICATIONS AND AN ARMOR SYSTEM CONSTRUCTED WITH A WRAPPED CERAMIC TILE FOR ARMOR APPLICATIONS

(71) Applicants: Robert F. Speyer, Atlanta, GA (US); Mark Luell, Atlanta, GA (US)

(72) Inventors: Robert F. Speyer, Atlanta, GA (US); Mark Luell, Atlanta, GA (US)

(73) Assignee: VERCO MATERIALS, LLC, Atlanta, GA (US)

( * ) Notice: Subject to any disclaimer, the term of this patent is extended or adjusted under 35 U.S.C. 154(b) by 0 days.

(21) Appl. No.: 15/157,715

(22) Filed: May 18, 2016

Related U.S. Application Data

(60) Provisional application No. 62/163,014, filed on May 18, 2015.

(51) Int. Cl.
*F41H 5/04* (2006.01)

(52) U.S. Cl.
CPC ..... *F41H 5/04* (2013.01)

(58) Field of Classification Search
CPC ..... F41H 5/04; F41H 5/0428; F41H 5/0492
USPC ..... 89/36.02
See application file for complete search history.

(56) References Cited

U.S. PATENT DOCUMENTS 4,911,061 A * 3/1990 Pivitt ..... F41H 5/0435 109/84
5,225,015 A * 7/1993 Allaire ..... C03B 11/14 156/155
6,389,594 B1 * 5/2002 Yavin ..... F41H 5/0428 2/2.5
7,300,893 B2 * 11/2007 Barsoum ..... B32B 25/04 2/2.5
7,874,239 B2 * 1/2011 Howland ..... F41H 1/02 2/2.5
8,075,661 B2 * 12/2011 Chen ..... C22C 1/051 419/14
8,087,143 B2 * 1/2012 DiPietro ..... F41H 5/0442 109/49.5
8,091,204 B2 * 1/2012 DiPietro ..... F41H 5/0442 109/49.5
8,267,001 B2 * 9/2012 Sayre ..... F41H 5/0421 89/36.02
2002/0178900 A1 * 12/2002 Ghiorse ..... F41H 5/0414 89/36.02
2009/0074604 A1 * 3/2009 Chen ..... C22C 1/051 419/18
2010/0043630 A1 * 2/2010 Sayre ..... F41H 5/0421 89/36.02
2010/0154587 A1 * 6/2010 Eason ..... C22C 1/051 75/230
2012/0291621 A1 * 11/2012 Sayre ..... F41H 5/0428 89/36.02

(Continued)

*Primary Examiner* — Joshua Freeman
(74) *Attorney, Agent, or Firm* — Ostrolenk Faber LLP

(57) ABSTRACT

A method of making an armor component that includes wrapping a ceramic tile with a plurality of wrappers that are impregnated with a curable polymer, and isostatically pressing the wrapped ceramic tile while curing the curable polymer to obtain an armor component that includes the ceramic tile integrated with the wrappers.

16 Claims, 5 Drawing Sheets

(56) References Cited

U.S. PATENT DOCUMENTS

| | | | | |
|---|---|---|---|---|
| 2013/0263727 | A1* | 10/2013 | O'Masta | F41H 5/023 89/36.02 |
| 2013/0284005 | A1* | 10/2013 | Grozdanich | F41H 5/00 89/36.02 |
| 2014/0305294 | A1* | 10/2014 | Micarelli | F41H 5/0442 89/36.02 |
| 2016/0131457 | A1* | 5/2016 | Bain | F41H 5/0428 89/36.02 |

* cited by examiner 22
20
Strike face: 12
20
10
20
20
22
Symmetry line
Rectangle cut edge
Cut edge 22
20
20
20
Reverse face: 14
20
10
18
16
18
18
22
scale = 1 inch

METHOD FOR WRAPPING OF CERAMIC TILES FOR ARMOR APPLICATIONS, A WRAPPED CERAMIC TILE FOR ARMOR APPLICATIONS AND AN ARMOR SYSTEM CONSTRUCTED WITH A WRAPPED CERAMIC TILE FOR ARMOR APPLICATIONS

CROSS-REFERENCE TO RELATED APPLICATIONS

The present application claims priority to U.S. Provisional Application Ser. No. 62/163,014, filed May 18, 2015, the entire disclosure of which is incorporated by reference herein.

FIELD OF THE INVENTION

Described herein are (a) a method of wrapping individual ceramic tiles suitable for use in the construction of armor to obtain an armor system with substantially improved mechanical and ballistic performance, (b) a wrapped ceramic tile fabricated according to the method, and (c) an armor system constructed with the wrapped tiles.

BACKGROUND & SUMMARY OF THE INVENTION

U.S. Pat. No. 8,434,396 (incorporated by reference), which is assigned to the assignee of the present application, discloses a hexagonal-shaped ceramic tile design (hereafter Verco tile).

U.S. Pat. No. 8,434,396 also discloses an armor system comprised of an imbricated pattern of Verco tiles that are wrapped with a ballistic fabric for use in the construction of a flexible/conformable personal armor system.

U.S. Pat. No. 8,434,396 discloses a method of wrapping the individual tiles with, for example, a glass fiber fabric, and encasing the imbricated pattern of the wrapped tiles in between ballistic fabric layers.

Ceramic tiles made from hard ceramics such as aluminum oxide ($Al_2O_3$), silicon carbide (SiC), and boron carbide ($B_4C$) have very effective strike faces for defeating projectiles such as armor piercing rifle rounds and shrapnel. Unlike ductile metals which flow out of the way of a penetrating projectile, the aforementioned brittle (no plastic flow) and very hard ceramics imbue a dwell period during early projectile/ceramic surface interaction, during which the projectile collapses upon itself and mushrooms laterally outward. During this period, a compressive wave extends to the back face of the ceramic tile and returns as a tensile wave to pulverize the ceramic tile. The projectile is then partially ablated by the loose ceramic as it penetrates through. The remaining kinetic energy of the projectile, or its fragments, is captured by a backing, typically made up of layers of pressed high molecular weight polyethylene fibers.

Personal armor plates, e.g. ESAPI plates (enhanced small arms protective insert, a U.S. military specification), are known to be effective against specified ballistic threats for the first impact, but multiple shots to the same plate are challenged by the propensity for the fracture cracks to extend well away from previous points of impact. Additional problems with such monolithic torso plates are their tendency to fracture with rough handling. Monolithic torso plates also impose a turtle-like rigid discomfort and immobility to the wearer.

A flexible armor system, by contrast, facilitates greater body-conformability and body movement. A flexible armor system also exhibits improved multi-hit capabilities since only the impacted tile is damaged. That is, the tiles surrounding the tile that has been hit may be left in pristine condition, with uncompromised ability to defeat the next projectile.

In an imbricated armor system, when a bullet hits a ceramic strike face near its edge, ballistic stopping performance decreases because of an increasing propensity for the ceramic to chip out of the way of the projectile. An imbricated tile flexible system has an array of near-edge regions that are not present in a monolithic plate. The design of an imbricated system typically compensates for the adverse effects of the near-edge regions by partially overlapping the ceramic tiles, so that the bullet interacts with more than one ceramic tile in the near-edge regions.

Wrapping the ceramic tiles with a strong fabric to reduce the probability of the ceramic chipping out of the way of the projectile is an important contributor to reducing the adverse edge effects created by the array of near edge regions in an imbricated armor system.

An objective of the disclosed method is a new method of wrapping ceramic tiles suitable for use in a flexible armor system, and optimizing the cohesion between the ceramic and the wrap.

Another objective is a wrapped ceramic tile suited for construction of a flexible armor system.

A further objective is a flexible armor system with wrapped ceramic tiles.

A method of making an armor component according to the present invention includes wrapping a ceramic tile with a plurality of wrappers impregnated with a curable polymer to obtain a wrapped tile and isostatic pressing the wrapped tile to integrate the wrappers and the tile while curing the polymer.

The isostatic pressing may be carried out in a chamber of an isostatic press. The method may further include initially pressurizing the chamber to a first pressure above atmospheric pressure while at a first, ambient temperature and thereafter further increasing pressure to a second higher pressure, while increasing temperature to a second, higher temperature to cure the polymer, and holding temperature of the chamber for a first period of time at the second temperature to cure the polymer. Thereafter, the chamber may be cooled from the second, higher temperature to a lower temperature above ambient temperature without venting the chamber to maintain the pressure inside the chamber, and then venting the chamber while maintaining the temperature of the chamber above ambient. Alternatively, the chamber may be vented to atmospheric pressure while maintaining the second, higher temperature for a second period of time.

Prior to isostatic pressing, the wrapped tile may be sandwiched between release fabrics to obtain a sandwiched and wrapped tile. The sandwiched and wrapped tile may be placed in a vacuum bag followed by evacuating the vacuum bag, thereby squeezing the wrappers into tighter contact with the tile. The bag is then sealed to obtain an air-tight enclosure.

The tile may include rounded corners, and the plurality of wrappers include at least a first wrapper and at least a second wrapper, each wrapper having a central portion and a plurality of leaves of varying lengths surrounding and extending from the central portion, at least some of the leaves being shorter than other leaves. The central portion of the first wrapper may be placed over the first side of the tile with the shorter leaves of the first wrapper being closer to the rounded corners of the tile, and the leaves of the first wrapper may be folded over to the second side of the tile. The central portion of the second wrapper may be placed over the second side of the tile with the shorter leaves of the second wrapper being closer to the rounded corners of the tile, and the leaves of the second wrapper may be folded over to the first side of the tile and the central portion of the first wrapper.

The second side may be the strike face of the tile.

The plurality of wrappers may include at least a third wrapper having a central portion and a plurality of leaves of varying lengths surrounding and extending from the central portion, at least some of the leaves being shorter than other leaves of the third wrapper. The central portion of the third wrapper may be placed over the first side of the tile with the shorter leaves of the third wrapper being closer to the rounded corners of the tile, and the leaves of the third wrapper may be folded over to the second side of the tile.

According to one aspect of the present invention, the leaves of the first wrapper and the leaves of the third wrapper are off-set by reversing the contacting face of the wrapper.

The tile may be symmetric about a symmetry line and the shape and seam positions of the leaves of the wrappers are asymmetric about the symmetry line.

The wrappers may be star-shaped with leaves that terminate at respective points. The polymer may comprise an epoxy and the wrappers may comprise carbon fibers.

A method according to the present invention can be used to fabricate an armor component that includes a tile wrapped with a plurality of polymer impregnated wrappers, in which the polymer penetrates microscopic surface cavities of the tile to mechanically bond the wrappers to the ceramic tile.

Preferably the tile comprises a ballistic material such as boron carbide, the polymer comprises cured epoxy and the wrapper comprises carbon fibers. Other ballistic materials such as silicon carbide can also be used without deviating from the present invention.

In the preferred embodiment, the tile includes a plurality of rounded corners. The plurality of wrappers include at least a first wrapper and at least a second wrapper, each wrapper having a central portion and a plurality of leaves of varying lengths surrounding and extending from the central portion, at least some of the leaves being shorter than other leaves. The central portion of the first wrapper resides over the first side of the tile with the shorter leaves of the first wrapper being closer to the rounded corners of the tile and the leaves of the first wrapper are folded over to the second side of the tile. The central portion of the second wrapper resides over the second side of the tile with the shorter leaves of the second wrapper being closer to the rounded corners of the tile, and the leaves of the second wrapper are folded over to the first side of the tile and the central portion of the first wrapper.

The plurality of wrappers may include at least a third wrapper having a central portion and a plurality of leaves of varying lengths surrounding and extending from the central portion, at least some of the leaves being shorter than other leaves of the third wrapper. The central portion of the third wrapper resides over the first side of the tile with the shorter leaves of the third wrapper being closer to the rounded corners of the tile, and the leaves of the third wrapper are folded over the second side of the tile.

An armor component made with a method according to the present invention may be used in an armor. Thus, an armor can be made by imbricating a plurality of armor components into an imbricated pattern.

BRIEF DESCRIPTION OF THE FIGURES

FIGS. 3A-3D illustrate a sequence of steps for obtaining a wrapped ceramic tile that is not discus-shaped (e.g. a Verco tile) with a carbon fiber pre-preg fabric cut according to FIG. 2A and FIG. 2B, in which FIG. 3A shows a first wrap in the sequence, FIG. 3B shows a second wrap in the sequence, FIG. 3C is a third wrap in the sequence, and FIG. 3D shows a tile after being wrapped three times and HIPed to cure the epoxy in the carbon fiber pre-preg fabric (i.e. a wrapped ceramic tile fabricated according to the present invention).

DESCRIPTION OF THE INVENTION

Flexible armor systems, such as DragonSkin™ are based on an imbricated pattern of ceramic discuses wrapped in E-glass. An example of the imbricated pattern using discus-shaped ceramic tiles is disclosed in U.S. Pat. No. 6,035,438.

According to the prior art, to improve adhesion to the ceramic tile, the ceramic tile is sand blasted (e.g. with alumina grit) to remove surface oils and graphite (graphite is often encountered on the surfaces of SiC and $B_4C$ parts).

Figure 1A:
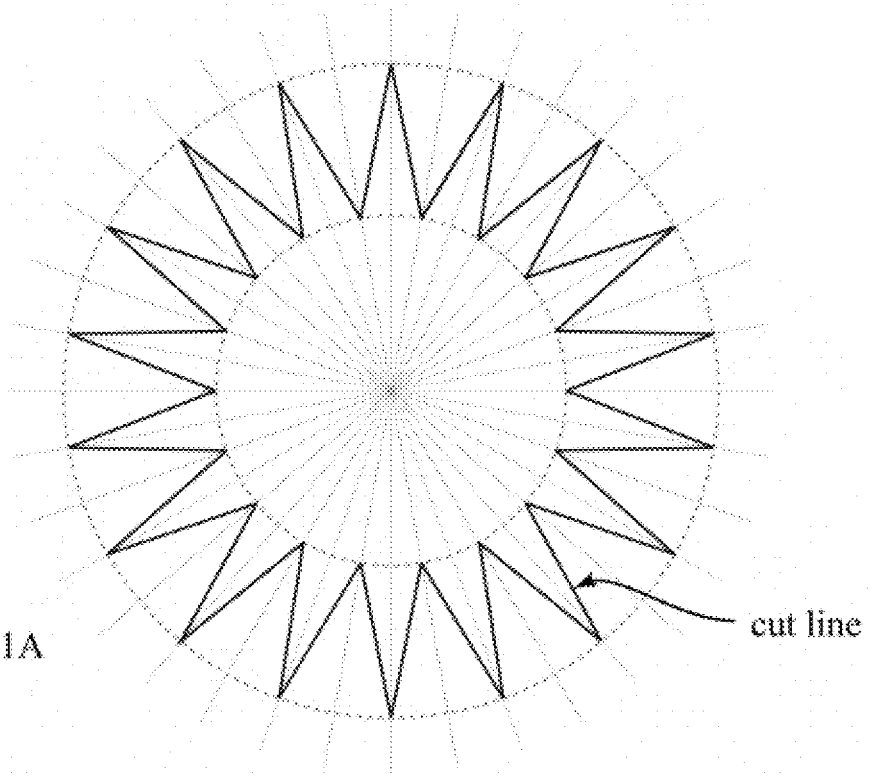
FIG. 1A illustrates a star-shaped cutout of a carbon pre-preg fabric, in which all lines with the exception of the heavy lines (labeled cut line) are for geometric construction purposes. The heavy lines depict the cutout edges. For this particular drawing, the inner dashed circle is 2.023 inches in diameter, and the outer dashed circle is 3.787 inches in diameter.

For ceramic discuses, the fabric is cut into a star pattern, as shown in FIG. 1A. The purpose of the star pattern is to prevent the fabric from bunching up as it wraps around to the other side of the discus. Such bunching-up degrades adhesion and also lifts one tile away from intimate contact with its neighbors in the imbricated pattern, leaving gaps between wrapped tiles which would be vulnerable to projectile penetration for impacts at an appropriate orientation.

Figure 1B:
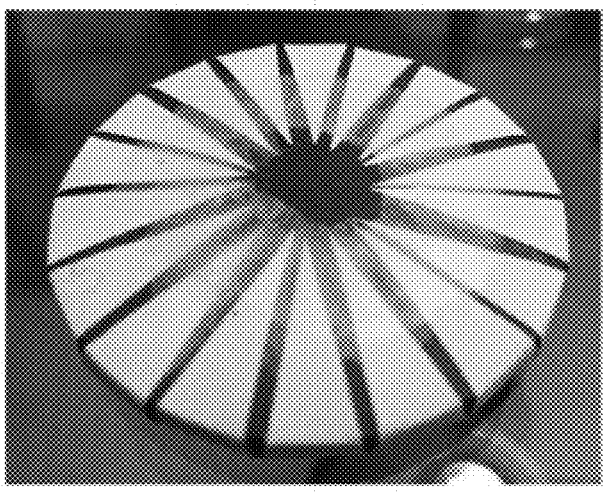
FIG. 1B is a top view of the cutout wrap of FIG. 1A (using white paper for illustration purposes) showing how the leaves of the cutout fold on to the opposite face of a discus ceramic tile.
Figure 1C:
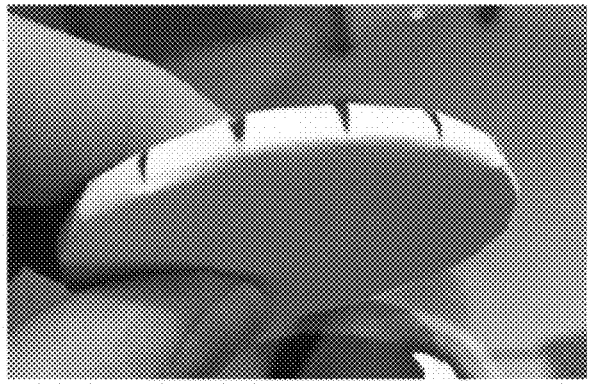
FIG. 1C is a side view showing small seams on the radial edge of the discus tile but no bunching up of the wrap.

As shown in FIGS. 1B and 1C, the wrap terminates on the opposite face of the discus, rather than on the edge of the discus. This method of wrapping facilitates the lateral containment of the ceramic tile, impeding the ability of the ceramic tile to chip out of the way of the projectile upon impact.

Two or more star-shaped wrappers may be applied in sequence. The wrappers may be misaligned to avoid complete overlapping of the leaves of the star-shaped pattern. This is for the purpose of ensuring that there is no uncovered ceramic along the discus edges.

In a method according to the present invention, a ceramic tile suitable for use in an armor system is wrapped with a ballistic wrapping material more than once, and preferably at least three times.

In the preferred embodiment, the ceramic tiles are not discus-shaped, and may be shaped and configured like the ceramic tiles disclose in U.S. Pat. No. 8,434,396 (i.e. Verco tiles)

U.S. Pat. No. 8,434,396 discloses individual wrapping of the ceramic tiles, but does not disclose using a star-shaped wrapper for wrapping each tile.

Figure 5A:
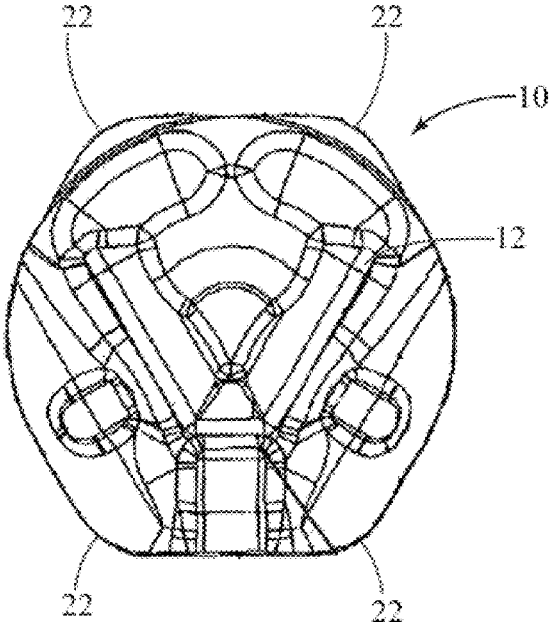
FIG. 5A shows the obverse face (strike face) of a Verco tile.
Figure 5B:
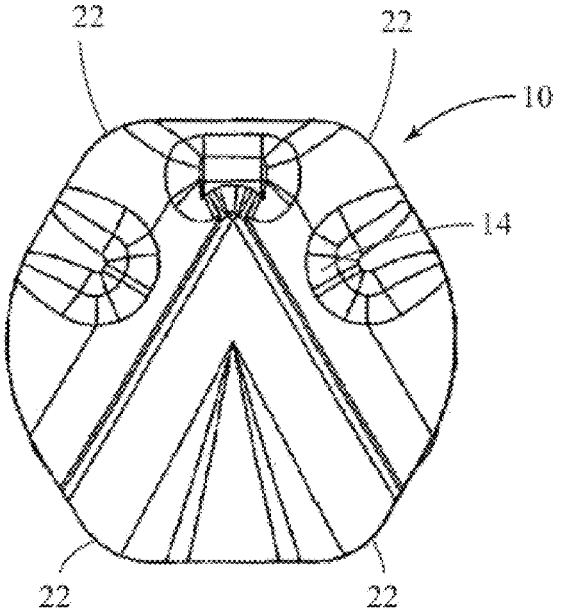
FIG. 5B shows the reverse face of a Verco tile.

Referring to FIGS. 5A and 5B, U.S. Pat. No. 8,434,396 discloses Verco tiles 10. A Verco tile 10 is not discus-shaped. A Verco tile has an obverse face 12 which serves as the strike face of the tile, and a reverse face 14.

It has been discovered that the rounded corners of a Verco tile cannot be wrapped properly with the star-shaped wrapper disclosed in FIG. 1A because the rounded corners of the hexagon shape of a Verco tile prevent minimizing the overlap of the leaves of the star-shaped wrapper shown in FIG. 1A when it is folded over to the other face of the tile.

Figures 2A, 2B:
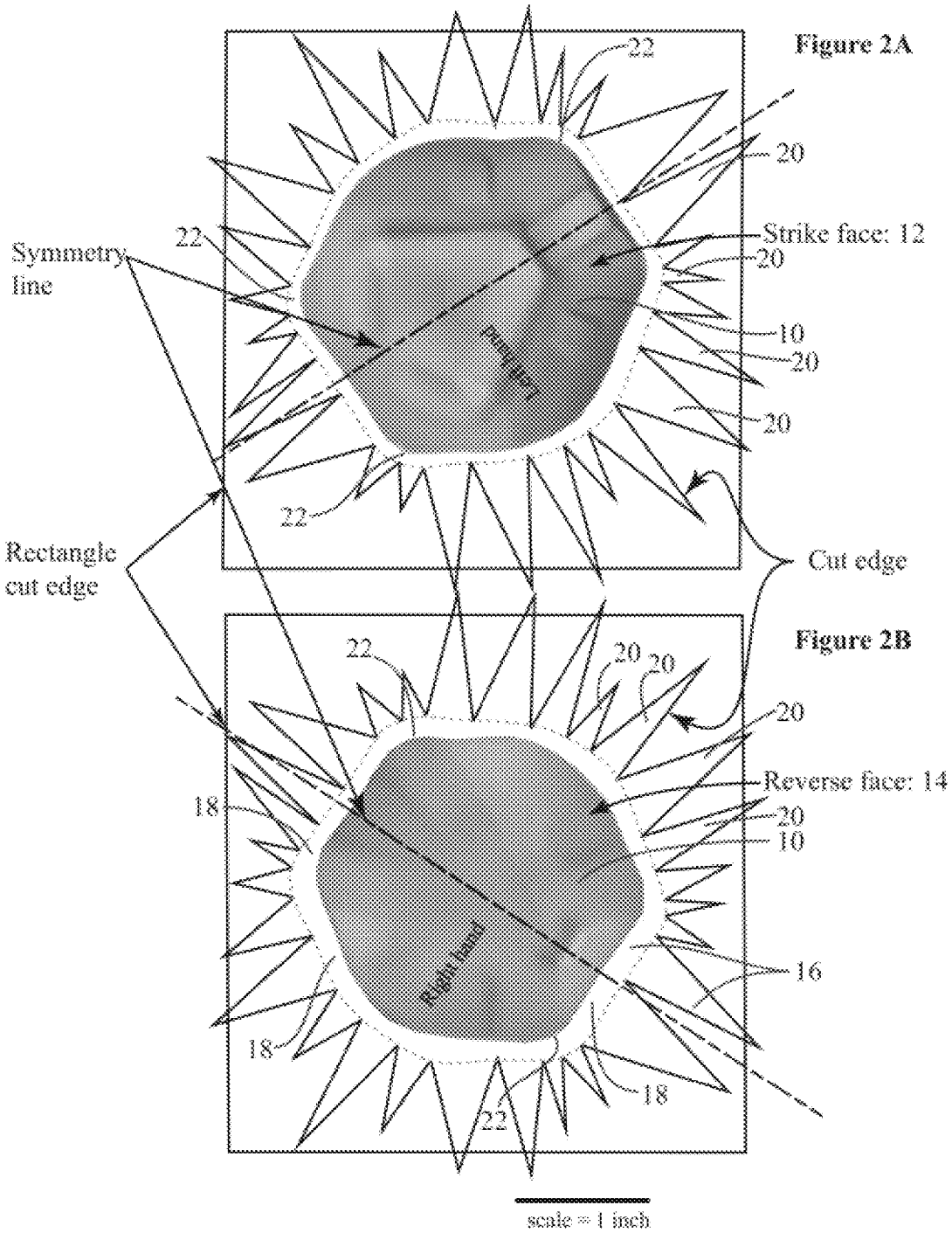
FIGS. 2A and 2B disclose a carbon fiber pre-preg fabric cut to a cover a ceramic tile that is not discus-shaped. The lines within the rectangles show the cutout edges of the carbon fiber pre-preg fabric to be wrapped around a Verco ceramic tile. The rectangle illustrates how the fabric can be cost-effectively cut from a larger sheet, in which some of the leaves are slightly truncated. For visualization, images of the obverse (strike face, FIG. 2A) and reverse (FIG. 2B) of the Verco tile are shown, centered in the fabric. The cutout appears oversized to facilitate the added actual surface area of the tile surfaces as opposed to the projected area.

In a method according to the present invention, a wrapper 16 having the pattern shown in FIG. 2A or FIG. 2B is used to wrap each individual ceramic tile 10. As seen in FIG. 2A and FIG. 2B, the wrapper includes a central portion 18 that will cover the obverse or the reverse side of the ceramic tile 10 and a plurality of leaves 20 of varying lengths surrounding and extending from the central portion 18. Thus, unlike the wrapper shown in FIG. 1A, a wrapper 16 used in a method according to the present invention will not have leaves of equal length. In a wrapper 16 used in a method according to the present invention, the leaves 20 in the vicinity of sharp, rounded corners 22 (FIGS. 2A, 2B, 5A, and 5B) of the ceramic tile 10 are shorter to minimize the overlap of the material on the reverse side 14 of the ceramic tile 10. The pattern of the wrapper 16 is purposely asymmetric about the symmetry line indicated in FIG. 2A and FIG. 2B so that if opposite faces of the fabric (forming a shape corresponding to a geometric reflection about the symmetry line) were overlaid, the seams formed between the leaves would not overlap.

Figure 3A:
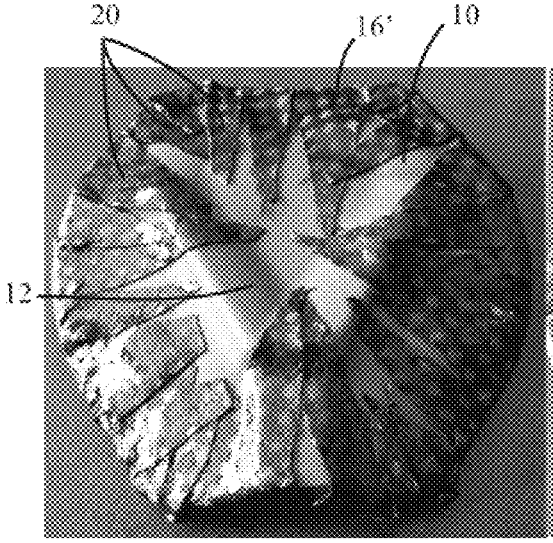

In a method according to the present invention, a first wrapper 16' having a pattern as shown as a wrapper 16 in FIG. 2B is applied to the ceramic tile 10 directly, with the central portion 18 thereof covering and in contact with the reverse face 14 of the tile and the leaves 20 thereof folded around the edges of the tile 10 and extending over and in contact with the obverse face 12 (strike face) of the tile 10. The result of the first step is shown in FIG. 3A, with the first wrapper labeled 16'.

Figure 3B:
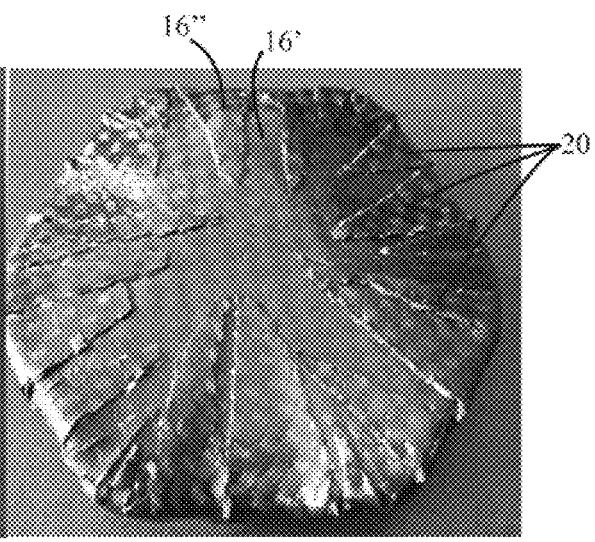

A second wrapper 16" as shown in FIG. 3B is applied to the ceramic tile covered by the first wrapper 16', with the central portion of the second wrapper over the obverse face 12 (the strike face in FIG. 2A) of the tile in contact with that face and the leaves of the first wrapper 16'. The leaves of the second wrapper 16" are wrapped around the edges of the tile and then over the reverse face 14 of the tile, making contact with the first wrapper 16'.

Figure 3C:
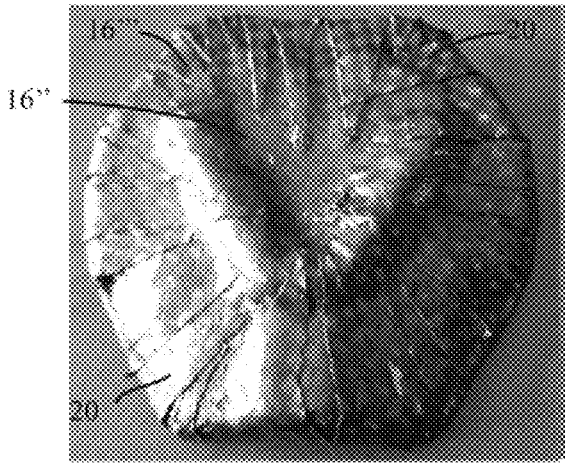
Figure 3D:
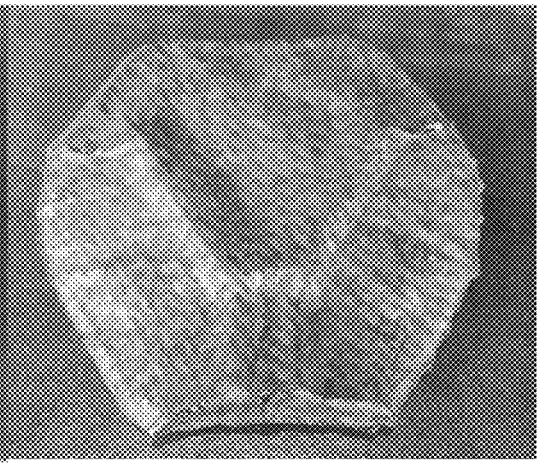

A third wrapper 16''' as shown in FIG. 3C is then applied with its central portion over the reverse face 14 of the tile, in contact with the first wrapper 16' and the leaves of the second wrapper 16" with its leaves wrapped around the edges of the ceramic tile and over the obverse face of the ceramic tile in contact with the second wrapper 16". The third wrapper 16' is applied to the tile after it is rotated 180 degrees about the symmetry line in FIG. 2A, so that the leaves are of different size and seam locations than the first wrapper 16'. The misalignment of the seams of the leaves of the first and third wrappers is for the purpose of ensuring no gaps in the wrap coverage of the tile edges. This sequence is preferred since the most continuous fabric after the three wrap layers is on the reverse face 14 of the tile 10, which is considered to be the more important face for enhanced reinforcement.

Figure 4:
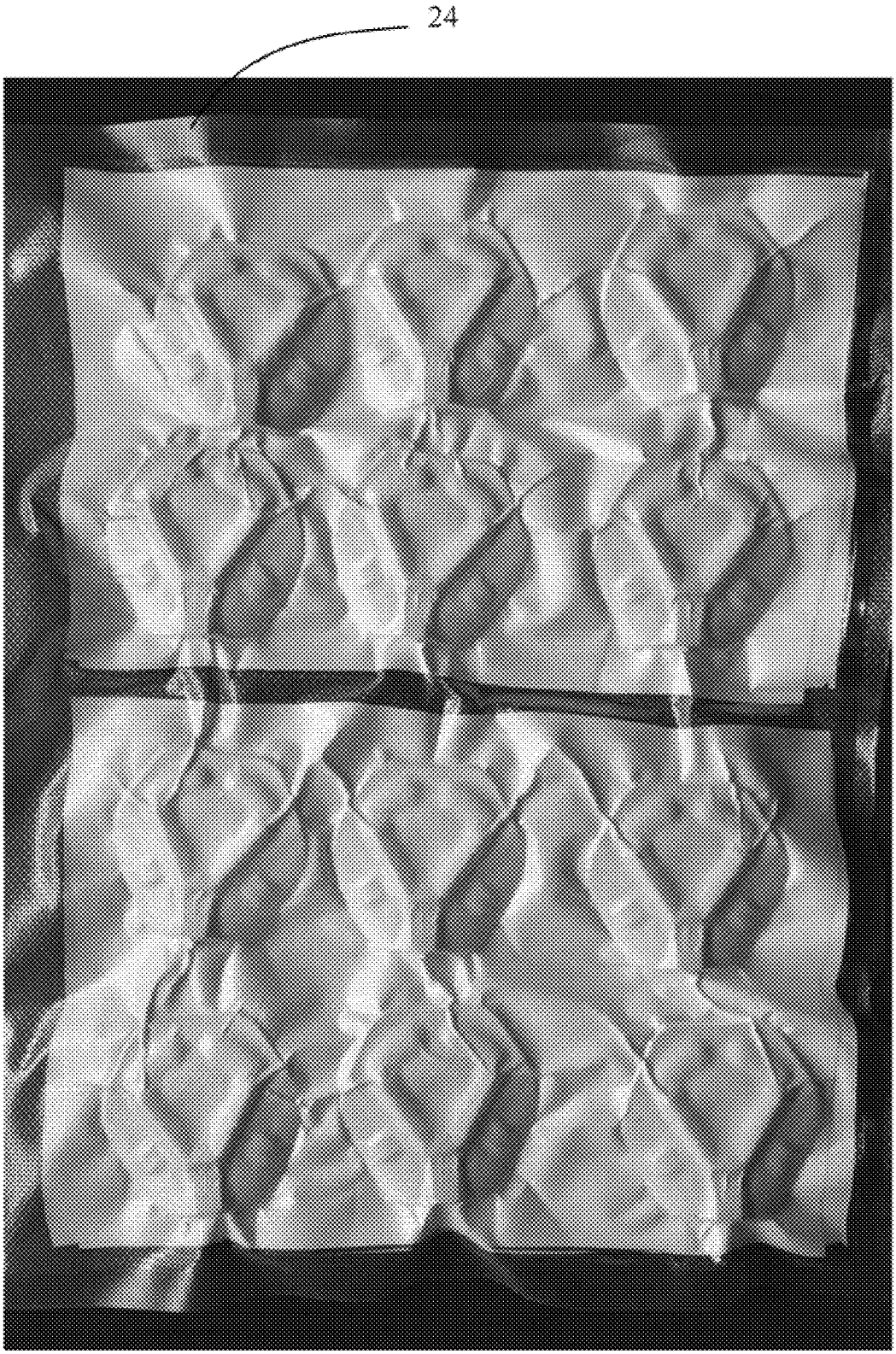
FIG. 4 illustrates ceramic tiles wrapped with carbon fiber pre-preg fabric placed between Tyvek sheets and sealed into clear plastic vacuum food sealer bags, ready to be thermally/hydrostatically processed in a hot isostatic press.

Referring to FIG. 4, the wrapped ceramic tiles are then sandwiched between release fabrics 23 such as Tyvek (DuPont de Nemours and Company), or alternately PTFE-coated fiberglass (PTFE: polytetrafluoroethylene, e.g. Teflon, Dupont). The sandwiched and wrapped tiles are in turn sealed in vacuum food sealer bags 24 (sealing system 6500101 pro 2100, using 15"×50" sealer bags, Weston, Strongsville, Ohio). The bags are then evacuated. As a result of vacuum evacuating the bags using a mechanical pump, 14 psi (atmospheric pressure) of hydrostatic pressure is applied to squeeze the wrappers into tighter contact with the tiles. The exterior perimeter of the vacuum bags are then sealed using pressure and heat to form a gas-tight enclosure. The purpose of forming a gas-tight enclosure is to ensure that gas during the HIPing process does not permeate inside the bag to equalize the pressure inside and outside the bag. Without the air-tight (sealed) bag, the HIP gas will permeate through and there will be no net pressure from outside to inside to squeeze the wrapped tile (i.e. it would be as if no pressure was applied).

The evacuated bags are then placed in a hot isostatic press (HIP). The chamber of the HIP is initially pressurized to 15,000 psi of argon gas at ambient temperature, the pressure is increased to 30,000 psi over 90 minutes as the chamber is heated to 135° C., and this temperature (135° C.) and pressure (30,000 psi) are held for an additional 90 minutes. During the last 90 minutes period, the epoxy in the pre-preg polymerizes and is set (cured). Alternately, a warm isostatic press in which the pressure transducing medium is heated water may be used.

The chamber is then cooled for 90 minutes from 135° C. to 40° C. without venting the gas to decrease the pressure. The pressure will decrease because of the cooling of the gas. The remaining pressure is then slowly released (~45 min) by venting the gas. The venting of the gas to depressurize the chamber will reduce the temperature of the chamber further. To compensate for cooling due to depressurization the furnace is controlled to maintain the temperature at 40° C. Without this control, depressurization could cool the parts to well below ambient temperature (frosty cold), which has been observed to have a negative effect on the adhesion of the wrappers to the ceramic tiles.

As an alternate method, the pressure is released by venting the gas after the last 90 minutes while still at the epoxy setting temperature of 135° C. The temperature of the chamber is held at 135° C. under atmospheric pressure for an additional 60 minutes. This allows for more extensive polymerization of the epoxy, which is otherwise restricted because of impeded polymer chain mobility under high pressure.

The parts are then cut out of the food sealing bags and the Tyvek fabrics are pulled away from the wrapped tiles.

Examples

Boron carbide Verco tiles were wrapped with pre-preg carbon fiber wrappers cut according to FIG. 2. Three wrappers were used for each Verco ceramic tile. To wrap each tile the method described above was used.

A suitable wrapping material for wrapping ceramic tiles according to the present invention used in an imbricated armor system is pre-preg fabric made with carbon fiber, for example, carbon fiber fabric pre-impregnated with an epoxy resin system, 14014-D, Rock West Composites, West Jordan, Utah.

The manufacturer's specification for setting the epoxy in the pre-preg carbon fiber was to hold the pre-preg carbon fiber under 50 psi at 135° C. for 90-120 min.

To prepare the examples, a substantially higher pressure (30,000 psi) than the recommended pressure was applied. The considerably higher pressure applied in this method substantially enhanced the adhesion of the epoxy to the ceramic surface by forcing the epoxy into microscopic surface cavities (open porosity) to enhance the mechanical bond between the wrapper and the ceramic tile.

Since the coefficient of thermal expansion (CTE) of the epoxy is much higher than the ceramic (CTE is inversely related to melting temperature), after cooling from the curing temperature, the set epoxy applies a hydrostatic compression to the ceramic. Since failure of ceramics occur because of tension or the tensile component of shear, putting the ceramic in isostatic compression increases the resistance of the ceramic to fracture.

Carbon fiber has the highest available specific stiffness (elastic modulus per unit weight). The ceramic rubble which forms is held tightly in place upon projectile impact if the ceramic tile is wrapped well. For the projectile to penetrate, the plume of ceramic debris must move out of the way of the projectile. A very stiff wrap tolerates very little lateral dilation of the ceramic tile, which would otherwise form an open volume for debris movement and escape. Thus, wrapping a ceramic tile with a carbon fiber fabric is preferred because it minimizes dilation of the ceramic tile.

As a preliminary evaluation, identically wrapped boron carbide Verco tiles (wrapped according to the method described herein) were impacted by a sledge hammer. The epoxy in one of the wrapped ceramic tiles was set at 135° C. and 14 psi, and the epoxy in another wrapped ceramic tile was set in the HIP at 135° C. and 30,000 psi. The wrapped tile exposed to 14 psi fractured on first contact and the contents were highly rubberized. The wrapped tile exposed to 30,000 psi required multiple impacts with the sledge hammer to show the first sign of fracture. The fracture was in the form of a small number of large pieces. Upon cutting open the wrapped tiles, the 14 psi tile showed debris well-separated from the wrap, while for the tile exposed to 30,000 psi, a layer of ceramic debris could be found still adhering to the wrap. Ballistic results comparing wraps with epoxy set at the two pressures showed greater ballistic consistency (from one shot to the next) for wrapped tiles with epoxy set at 30,000 psi.

A ceramic tile wrapped according to the present invention can be used in an imbricated armor system as for example disclosed in U.S. Pat. No. 8,434,396. Thus, for example, a personal armor system (a vest or jacket) can be made using ceramic tiles (preferably Verco tiles) wrapped according to the method disclosed herein and imbricated according to, for example, the imbrication disclosed in U.S. Pat. No. 8,434,396.

The time and temperature values set forth herein follow the manufacturer's specifications for curing the polymer in the pre-preg. However, the pressure values are much higher than the pressures recommended by the manufacturer. While the epoxy setting time should not be lower than the recommended values, extending the setting time to as much as twice the recommended value would be acceptable. The recommended cure temperature should be held within +/−10 deg C.

With respect to application of pressure, the applied pressure is well above those that could be achieved by an autoclave (the pre-preg manufacturer's specification), which can achieve isostatic pressures up to −100 psi. In a process according to the present invention, a pressure range of 3000 to 60,000 psi is recommended. HIPs can typically apply either 15,000 or 30,000 psi. A cold isostatic press, which uses water instead of argon, can go as high as 60,000 psi, however, the water needs to be heated to the curing temperature, which is commonly referred to as a warm isostatic press. It should be noted that that extreme pressures can prohibit the epoxy from setting all the way. Releasing pressure at the curing temperature, and then continuing the setting dwell to allow setting to complete should ensure that the high pressure does not interfere with curing of the polymer.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of making an armor component, the method comprising:

wrapping a ceramic tile with a plurality of wrappers impregnated with a curable polymer to obtain a wrapped tile;

isostatic pressing the wrapped tile to integrate the wrappers and the tile while curing the polymer;

wherein the tile includes rounded corners, and the plurality of wrappers include at least a first wrapper and at least a second wrapper, each wrapper having a central portion and a plurality of leaves of varying lengths surrounding and extending from the central portion, at least some of the leaves being shorter than other leaves;

placing the central portion of the first wrapper over the first side of the tile with the shorter leaves of the first wrapper being closer to the rounded corners of the tile;

folding the leaves of the first wrapper over to the second side of the tile;

placing the central portion of the second wrapper over the second side of the tile with the shorter leaves of the second wrapper being closer to the rounded corners of the tile; and folding the leaves of the second wrapper over to the first side of the tile and the central portion of the first wrapper.

2. The method of claim 1, wherein the isostatic pressing is carried out in a chamber of an isostatic press, and further comprising initially pressurizing the chamber to a first pressure above atmospheric pressure while at a first, ambient temperature and thereafter further increasing pressure to a second higher pressure, while increasing temperature to a second, higher temperature to cure the polymer, and holding temperature of the chamber for a first period of time at the second temperature to cure the polymer.

3. The method of claim 2, further comprising cooling the chamber from the second, higher temperature to a lower temperature above ambient temperature without venting the chamber to maintain pressure inside the chamber, and then venting the chamber while maintaining the temperature of the chamber above ambient.

4. The method of claim 2, further comprising venting the chamber to atmospheric pressure while maintaining the second, higher temperature for a second period of time.

5. The method of claim 3, further comprising, prior to the isostatic pressing step, sandwiching the wrapped tile between release fabrics to obtain a sandwiched and wrapped tile, placing the sandwiched and wrapped tile in a vacuum bag, evacuating the vacuum bag, thereby squeezing the wrappers into tighter contact with the tile, and sealing the bag to obtain an air-tight enclosure.

6. The method of claim 4, further comprising, prior to the isostatic pressing step, sandwiching the wrapped tile between release fabrics to obtain a sandwiched and wrapped tile, placing the sandwiched and wrapped tile in a vacuum bag, evacuating the vacuum bag to squeeze the wrappers into tighter contact with the tile, and sealing the bag to obtain an air-tight enclosure.

7. The method of claim 1, wherein the plurality of wrappers include at least a third wrapper having a central portion and a plurality of leaves of varying lengths surrounding and extending from the central portion, at least some of the leaves being shorter than other leaves of the third wrapper;

placing the central portion of the third wrapper over the first side of the tile with the shorter leaves of the third wrapper being closer to the rounded corners of the tile;

folding the leaves of the third wrapper over to the second side of the tile.

8. The method of claim 7, wherein the leaves of the first wrapper and the leaves of the third wrapper are off-set by reversing the contacting face of the wrapper.

9. The method of claim 8, wherein the second side is the strike face of the tile.

10. The method of claim 7, wherein the tile is symmetric about a symmetry line and wherein the shape and seam positions of the leaves of the wrappers are asymmetric about the symmetry line.

11. The method of claim 10, wherein the wrappers are star-shaped with leaves that terminate at respective points.

12. The method of claim 8, wherein the polymer comprises an epoxy and the wrappers comprise carbon fibers.

13. A method of making armor, comprising imbricating a plurality of components made according to the method of claim 1 into an imbricated pattern.

14. An armor component comprising:

a tile wrapped with a plurality of polymer impregnated wrappers, wherein the polymer penetrates microscopic surface cavities of the tile to mechanically bond the wrappers to the ceramic tile;

wherein the tile includes a plurality of rounded corners and wherein the plurality of wrappers include at least a first wrapper and at least a second wrapper, each wrapper having a central portion and a plurality of leaves of varying lengths surrounding and extending from the central portion, at least some of the leaves being shorter than other leaves;

the central portion of the first wrapper residing over the first side of the tile with the shorter leaves of the first wrapper being closer to the rounded corners of the tile;

the leaves of the first wrapper being folded over to the second side of the tile;

the central portion of the second wrapper residing over the second side of the tile with the shorter leaves of the second wrapper being closer to the rounded corners of the tile; and the leaves of the second wrapper being folded over to the first side of the tile and the central portion of the first wrapper.

15. The component of claim 14, wherein the tile comprises boron carbide, the polymer comprises cured epoxy and the wrapper comprises carbon fibers.

16. The component of claim 14, wherein the plurality of wrappers include at least a third wrapper having a central portion and a plurality of leaves of varying lengths surrounding and extending from the central portion, at least some of the leaves being shorter than other leaves of the third wrapper;

the central portion of the third wrapper residing over the first side of the tile with the shorter leaves of the third wrapper being closer to the rounded corners of the tile; and the leaves of the third wrapper being folded over the second side of the tile.

* * * * *